US006976578B1

(12) United States Patent
Kenihan

(10) Patent No.: US 6,976,578 B1
(45) Date of Patent: Dec. 20, 2005

(54) DISPENSING LID CLOSURE FOR BEVERAGE CONTAINER AND METHOD OF MAKING AND USING THE CLOSURE

(76) Inventor: Antony Austin Kenihan, 9 Rimrock, Irvine, CA (US) 92612

( * ) Notice: Subject to any disclaimer, the term of this patent is extended or adjusted under 35 U.S.C. 154(b) by 412 days.

(21) Appl. No.: 10/139,209

(22) Filed: May 7, 2002

(51) Int. Cl.[7] ..... B65D 25/08

(52) U.S. Cl. ..... 206/222; 206/219; 206/568; 215/DIG. 8; 215/227

(58) Field of Search ..... 206/219–222, 206/217, 568; 215/DIG. 8, 227; 426/112, 426/115, 120

(56) References Cited

U.S. PATENT DOCUMENTS

| | | | | |
|---|---|---|---|---|
| 2,824,010 A | | 2/1958 | Pedersen | 99/171 |
| 3,039,644 A | | 9/1962 | Lefcort | 220/20 |
| 3,074,592 A | * | 1/1963 | Stocking | 220/278 |
| 3,305,368 A | | 2/1967 | Bourelle | 99/171 |
| 3,326,363 A | | 6/1967 | Bennett et al. | 206/47 |
| 3,743,520 A | | 7/1973 | Croner | 99/171 |
| 3,779,372 A | | 12/1973 | de Lloret | 206/47 |
| 3,796,813 A | | 3/1974 | Kurland | 99/78 |
| 4,634,003 A | * | 1/1987 | Ueda et al. | 206/221 |
| 4,689,044 A | * | 8/1987 | Murata | 604/306 |
| 4,785,931 A | | 11/1988 | Weir et al. | 206/222 |
| 4,808,172 A | * | 2/1989 | Murata | 604/306 |
| 5,035,320 A | | 7/1991 | Plone | 206/219 |
| 5,052,553 A | | 10/1991 | De Sanctis | 206/222 |
| 5,273,171 A | * | 12/1993 | Steele-Rowland et al. | 215/11.1 |
| 5,431,276 A | | 7/1995 | Lialin | 206/202 |
| 5,529,179 A | | 6/1996 | Hanson | 206/219 |
| 5,711,420 A | | 1/1998 | Spring | 206/222 |
| 5,885,635 A | | 3/1999 | Spring et al. | 426/120 |
| 5,934,493 A | | 8/1999 | Han | 215/227 |
| 5,979,647 A | | 11/1999 | Han | 206/222 |
| 6,105,760 A | | 8/2000 | Mollstam et al. | 206/222 |
| 6,170,654 B1 | | 1/2001 | Gartner et al. | 206/219 |
| 6,209,718 B1 | | 4/2001 | Mollstam et al. | 206/222 |
| 2002/0157970 A1 | * | 10/2002 | Carlson | 206/222 |

* cited by examiner

*Primary Examiner*—Jila M. Mohandesi
(74) *Attorney, Agent, or Firm*—Blank Rome LLP

(57) ABSTRACT

A lid closure for dispensing a fluent material into a hot or cold beverage container comprises a one-piece molded lid closure with one or more sealed compartments containing the fluent material and an integrally molded conical recess associated with each compartment that can be deflected to puncture a hole in a thin foil or plastic layer sealing the compartment. The conical recess is deflected by pressure applied by the consumer and when the pressure is released, automatically retracts from the hole formed in the sealing layer to permit the fluent material to discharge into the container.

23 Claims, 4 Drawing Sheets

DISPENSING LID CLOSURE FOR BEVERAGE CONTAINER AND METHOD OF MAKING AND USING THE CLOSURE

BACKGROUND OF THE INVENTION

1 . Field of the Invention

The present invention relates to lid closures for containers and methods of making and using the lid closure, and more particularly to a molded plastic lid closure having one or more compartments for holding one or more fluent materials to be dispensed into the container by a consumer and methods of making and using the same.

2 . Description of the Prior Art

Plastic lid closures for sealing beverage containers, such as containers purchased by consumers at so-called "fast-food" restaurants and "convenience" stores are well known in the art. It has also been heretofore proposed to provide pockets or compartments in molded plastic lid closures that contain fluent materials, such as powdered cream or sugar, for use by a consumer to dispense into a container of a beverage tea or coffee to which the lid closure is secured. One such proposed lid closure is described in U.S. Pat. No. 3,326,363 to Bennett et al. The lid closure described in the Bennett et al. patent is molded of a polystyrene plastic material with a generally U-shaped annular lip for engaging the rim of a paper or plastic container. The molded lid is provided with a plurality of pockets that are closed and sealed on the underside of the lid by a circular sealing sheet of a tearable metal foil or plastic film. The lid is further provided with a pair of triangular bottom wall sections that are designed to tear the circular sealing sheet on the underside of the lid when pressure is applied by a consumer to the top of the lid at one of the pockets.

The operability of the Bennett et al. lid closure is dependent upon the effectiveness of the triangular bottom wall sections of the lid to create linear tears in the circular sealing sheet closing the bottoms of the pockets containing the fluent material. However, the force applied to the lid to create such linear tears in the sealing sheet is likely to be so great as to cause permanent deformation of the lid or excessive inward deflection of the lid closure and possible disengagement of the lip of the lid from the container rim and spillage of the beverage in the container. In the case of hot beverages like coffee, the possibility exists that the beverage will burn a consumer's hand or fingers.

A number of other proposals for fluent material dispensing lid closures for beverage containers have been heretofore made, as exemplified by the lid closures disclosed in U.S. Pat. Nos. 3,796,813 to Kurland; 4,785,931 to Weir et al.; 5,431,276 to Lialin; and 5,529,179 to Hanson. Typically, the prior art lid closures of these patents involve the application of pressure by the consumer to a pocket or compartment in the lid to release a fluent ingredient or material into the container to which the lid is attached. In the case of the patents to Weir et al. and Lialin, the lid closures are formed or provided with plungers or piercing devices for rupturing a foil or membrane forming the bottom wall of the compartments in the lid. The relative complexity of the design or molding for many of these prior art dispensing lid closures make them uneconomical to manufacture.

Accordingly, it would be desirable to provide a dispensing lid closure that has a simple shape for ease in molding and which has structure in the molded shape adapted to release the contents of one or more separate compartments containing fluent materials by puncturing a thin film layer of metal foil or plastic closing the compartments.

SUMMARY OF THE INVENTION

The present invention overcomes the drawbacks of the prior art dispensing lid closures by providing a simple, one-piece molded, thermoformed or vacuum-formed plastic lid closure for a container, the lid closure having one or more raised arcuate sections on the top of the lid closure, and a sealing layer on the bottom of the lid closure for forming one or more closed compartments adapted to contain liquid or solid fluent materials, and molded or formed conical depressions or recesses in each arcuate section, each recess forming a downwardly pointed element for puncturing the sealing layer and releasing the fluent material in a respective compartment into the container. One preferred method for forming the plastic lid closure of the present invention is known in the forming art as a rotary form fill and seal process.

The conical recesses formed in the arcuate sections are preferably molded or formed in the center of a slightly domed or upwardly convex circular portion to which pressure can be applied by a consumer to depress the domed portion to a downwardly concave position and deflect the pointed conical element inwardly to puncture a hole in the sealing layer and when pressure is released from the domed portion, it returns, e.g., "oil cans," to its convex domed configuration and retracts the tip of the pointed conical element from the sealing layer to allow the fluent material to pass through the hole in the sealing layer formed by the pointed conical element.

In a preferred embodiment, two approximately 180° arcuate sections are molded in the top of the lid closure with one circular convex domed portion and conical recess in each arcuate portion. An X-shaped perforation or weakened region is formed in a central circular area of the lid closure through which a drinking straw may be inserted in a conventional manner. The lid closure is preferably molded or vacuum-formed of a white polystyrene plastic material of the type conventionally used to manufacture lid closures for beverage containers. A transparent plastic material may also be used so that the material contained in the dispensing lid closure may be viewed by the consumer. Moldable or vacuum-formable plastic materials other than polystyrene may also be used to manufacture the lid closure, such as polypropylene, polyethylene terephthalate (PET), high-density polyethylene (HDPE) or expanded polyethylene (EPE). An especially preferred material for making the lid closure is a coextruded polystyrene/polyethylene sheet material, which is heat sealable, or any other coextruded combination of a vacuum-formable lid material with a heat sealable exterior layer that is disposed on the underside of the lid closure.

The underside of the molded lid closure has two narrow annular sealing surfaces located radially inwardly of a U-shaped lip on the lid periphery, one annular sealing surface being located inside of and concentric to the other annular sealing surface, and two narrow linear sealing surfaces extending radially between the two annular sealing surfaces and coplanar therewith to form coplanar sealing surfaces to which the sealing layer is adhesively bonded or otherwise sealingly affixed to seal the underside of the arcuate compartments.

Preferably, the sealing layer comprises a metal foil or polymeric layer having a washer-like shape, that is, a circular peripheral shape with a central circular opening. When the sealing layer is applied to the lid closure, the central circular opening in the sealing layer is registrable with the central circular area of the lid closure in which the X-shaped region for the drinking straw is located. A preferred material for the sealing layer is aluminum foil that is adhesively affixed to the sealing surfaces on the underside of the lid closure. The foil may have an adhesive layer applied over the entire area of one of its surfaces or in a pattern only to those areas of the foil that contact the sealing surfaces on the underside of the lid closure. Alternatively, the lid closure may have an adhesive layer applied to its underside surfaces as described hereinafter. The adhesive layer may be any suitable adhesive used in the food packaging industry, such as linear low-density polyethylene (LLDPE). Other polymeric materials may also be used for the adhesive layer, such as ethylene acrylic acid (EAA), polyethylene, low density polyethylene (LDPE), Surlyn®, a polymeric resin made by du Pont, ethylene vinyl alcohol (EVOH) or Barex®, an acrylonitrile-methyl acrylate copolymer made by BP Amoco, or any other suitable copolymer or homopolymer.

The compartment or compartments of the dispensing lid closure of the invention are preferably filled with a liquid, granular or powdered material by inverting the lid closure so that the compartment or compartments are upwardly open, and then charging a predetermined quantity of material into each compartment. It will be appreciated that the contents of the compartments for a lid closure with two compartments may be the same or different components, e.g., two of the same liquid or granular material, two different liquids or granular materials, one liquid, one granular material, etc. It will also be understood that the lid closure of the invention may have only one compartment containing a single fluent material to be dispensed into the container. The one compartment may be provided with one or more domed portions with conical recesses for puncturing one or more holes in the sealing layer.

The sealing layer is adhesively or heat sealingly bonded to the coplanar sealing surfaces of the lid closure when the lid closure is in its inverted filling position to seal the fluent material in a respective compartment. An especially preferred combination of materials for the lid closure and sealing layer is a single sheet aluminum foil sealing layer and a lid closure made of the above-mentioned coextruded polystyrene/polyethylene vacuum-formable sheet material wherein the polyethylene layer of the lid closure is heat sealable. The aluminum foil sealing layer may be heat sealed to the lid closure using a heating platen designed to engage and press corresponding areas of the sealing layer against the coplanar polyethylene sealing surfaces of the lid closure.

The completed dispensing lid closures may then be packaged in packages of single or multiple lids for wholesale or retail distribution, or for use in the "fast food" industry or the "convenience store" industry. In that regard, during the lid molding or forming process, trademarks, logos, instructions for use and other indicia are preferably molded into the plastic material of the lid closure. For example, the consumer instruction "Press Here" may be molded into or adjacent the circular domed portions on the arcuate sections of the lid.

One preferred form of packaging comprises a cylindrical dispensing sleeve made of cardboard, plastic or other suitable material that contains a plurality of charged or filled lid closures stacked one above the other with a means to dispense individual lid closures from one end of the sleeve. The sleeve may be mounted to a vertical wall surface, e.g., in a "fast food" establishment or a "convenience" store, with the longitudinal axis of the sleeve oriented vertically. Alternatively, the sleeve may be a disposable element inserted in a permanent, wall-mounted dispenser.

To use a completed dispensing lid closure of the invention, the U-shaped lip of the lid closure is attached to the rim of a container or cup. If it is desired to dispense the contents of one or more of the lid closure compartments into the container, the domed portion of an arcuate section is pressed downwardly so that the pointed end or tip of the conical recess engages and punctures a hole in the sealing layer through which the contents of the associated compartment is dispensed into the contents of the container. The contents of another compartment may be dispensed in the same manner. Depending on the desires of the consumer, a drinking straw may be used to consume the container contents by inserting the straw through the X-shaped perforation or weakened region formed in a central circular area of the lid closure, or the lid may be removed entirely from the container by the consumer for consumption of the contents of the container.

The present invention is useful in a number of applications, some but not all of which are described herein. Those skilled in the art will appreciate the various possible applications of the dispensing lid closure of the invention. In a preferred application, the dispensing lid closure of the invention is used to contain a liquid, powdered or granular flavorant for a cold or hot beverage, e.g., a syrup flavorant or granular candy for a carbonated beverage, The invention has several objects, namely:

(1) to achieve a simpler design of a dispensing lid closure;
(2) to decrease costs by replacing complex, multi-part lid designs with a one-piece plastic molded lid closure;
(3) to increase safety in using dispensing lid closures for hot beverages;
(4) to provide a dispensing lid closure design that is especially suitable for mass production; and
(5) to provide a dispensing lid closure designed especially for use in the "fast food" and "convenience store" industries to add flavors or flavoring to beverages.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
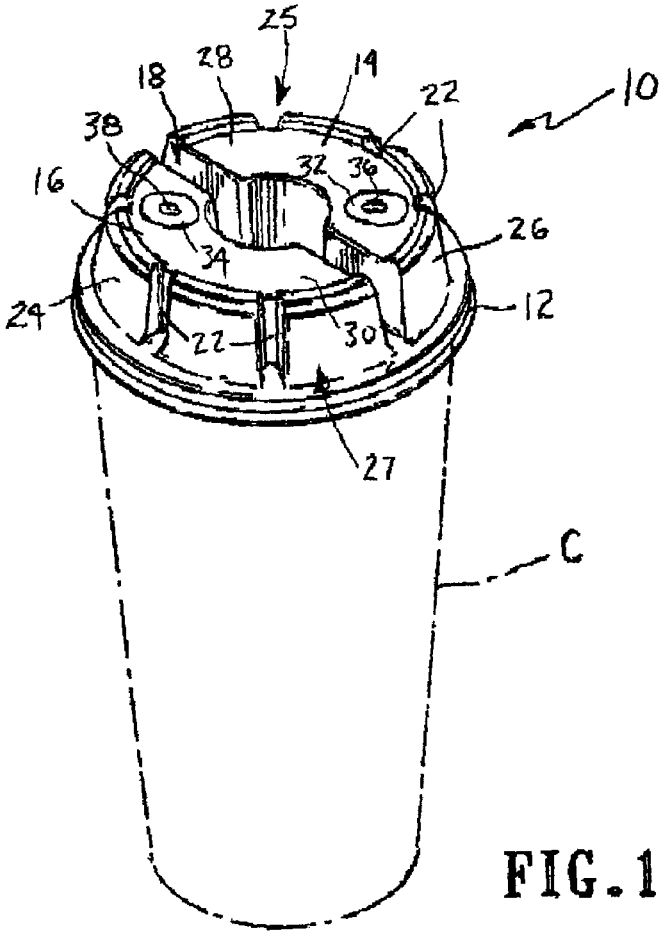
FIG. 1 is a perspective view of an embodiment of the dispensing lid of the invention shown attached to a beverage container.
Figure 4:
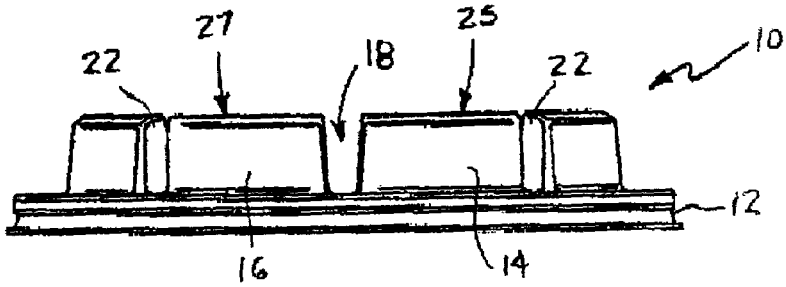
FIG. 4 is a side elevation view of the dispensing lid of the invention.
Figure 5:
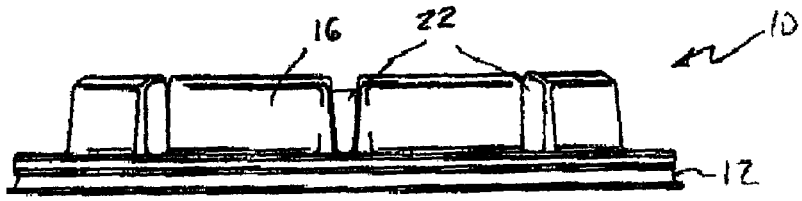
FIG. 5 is another side elevation view of the dispensing lid of the invention taken at right angles to the view of FIG. 4.

Referring now to FIGS. 1, 4 and 5, there is shown a preferred embodiment of the invention in the form of a dispensing lid closure 10 for a beverage container C shown in dash-dot lines. Lid closure 10 is preferably molded or formed by a conventional manufacturing process, such as vacuum forming, from a thin sheet of plastic material, such as polystyrene. As seen in FIG. 1, the lid 10 is provided with an annular skirt 12 adapted to securely engage the upper lip of the beverage container C in a conventional manner. Elevated above the skirt 12 is a pair of raised arcuate sections 14, 16 separated by a diametric trough or recess 18 having a central circular portion 20. The raised arcuate sections 14, 16 are strengthened or stiffened by radial indentations or castellations 22 formed in the circumferential walls 24, 26 of the arcuate sections 14, 16. Each arcuate section 14, 16 forms a respective compartment 25, 27 for containing a fluent material as described in more detail hereinafter.

The top surfaces 28, 30 of the arcuate sections 14, 16 are provided with a pair of circular, upwardly convex domed portions 32, 34 each with a conical depression or recess 36, 38 formed in the center thereof. Top surfaces 28, 30 may also be provided with indicia, such as trademarks, logos and the like to identify the contents of the compartments, the supplier of the dispensing lid and other marketing information. Preferably, the indicia is formed directly into the lid when it is molded or vacuum formed, but it may also be applied after molding or forming by printing, adhesive labeling or by any other suitable method.

Figure 2:
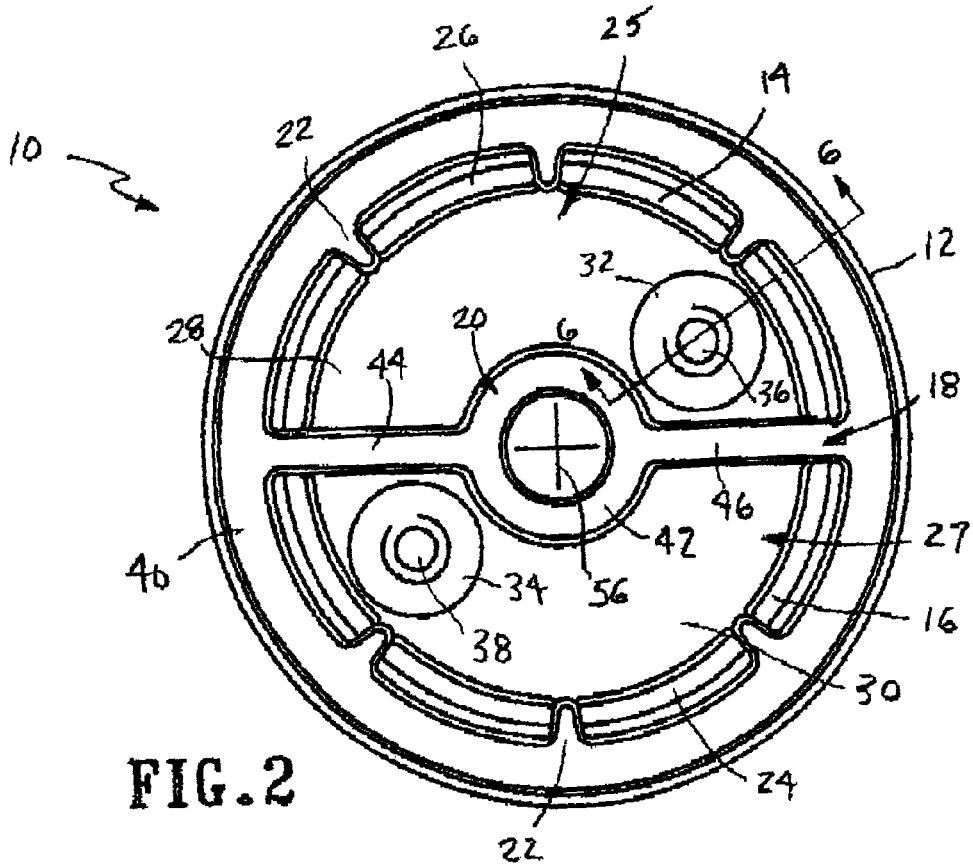
FIG. 2 is a top plan view of the dispensing lid of the invention.
Figure 3:
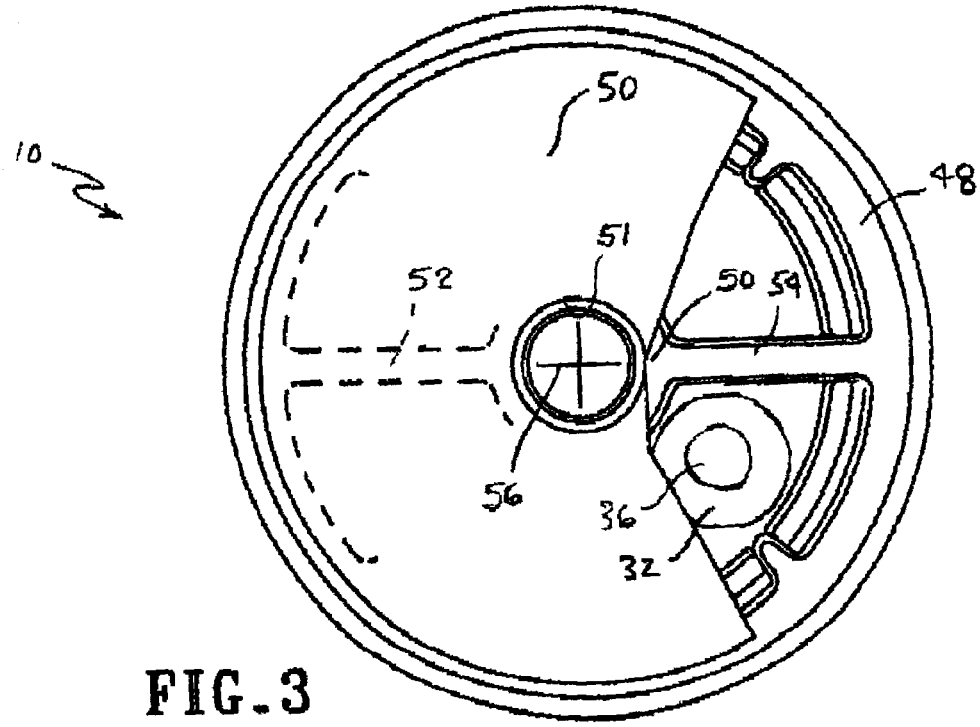
FIG. 3 is a bottom plan view of the dispensing lid of the invention with the sealing layer shown partly broken away.

FIGS. 2 and 3 show top and bottom views, respectively, of the dispensing lid closure 10 of FIG. 1. As best seen in FIG. 2, the lid closure 10 is formed with two concentric annular surfaces 40, 42 and two linear surfaces 44, 46 extending radially between the annular surfaces 40, 42. The undersides of surfaces 40–46 form coplanar sealing surfaces 48, 50, 52, 54 as shown in FIG. 3. After the compartments 25, 27 have been charged with fluent material, a washer-like sealing layer 50, made of metal foil, such as aluminum foil, or other single or multilayer sheet material, is sealingly affixed to the sealing surfaces 48-52 to seal the fluent material in a respective compartment 25, 27. Preferably, the sealing layer 50 is heat sealed to the sealing surfaces 48–52 which are formed by a heat sealable layer of a coextruded lid closure material, such as a polystyrene/polyethylene coextrusion. Alternatively, the aluminum foil may have an adhesive applied to one entire surface thereof or in a predetermined pattern to selected portions of said one surface.

Figure 9:
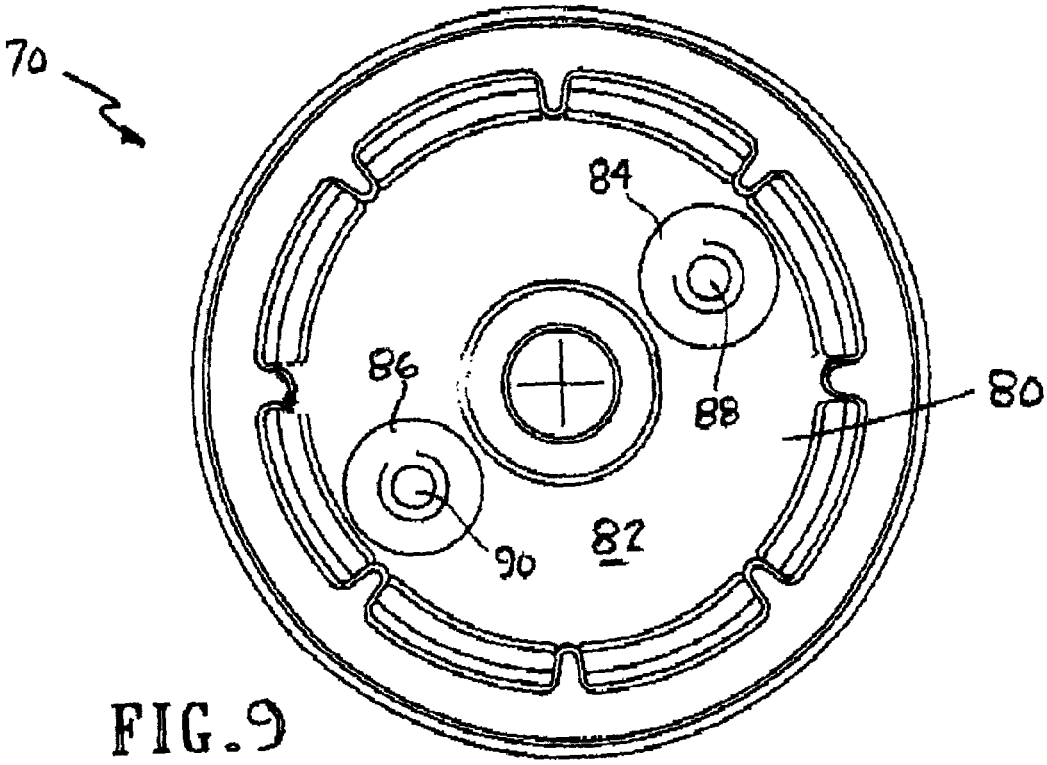
FIG. 9 is a top plan view of another embodiment of the dispensing lid of the invention.
Figure 10:
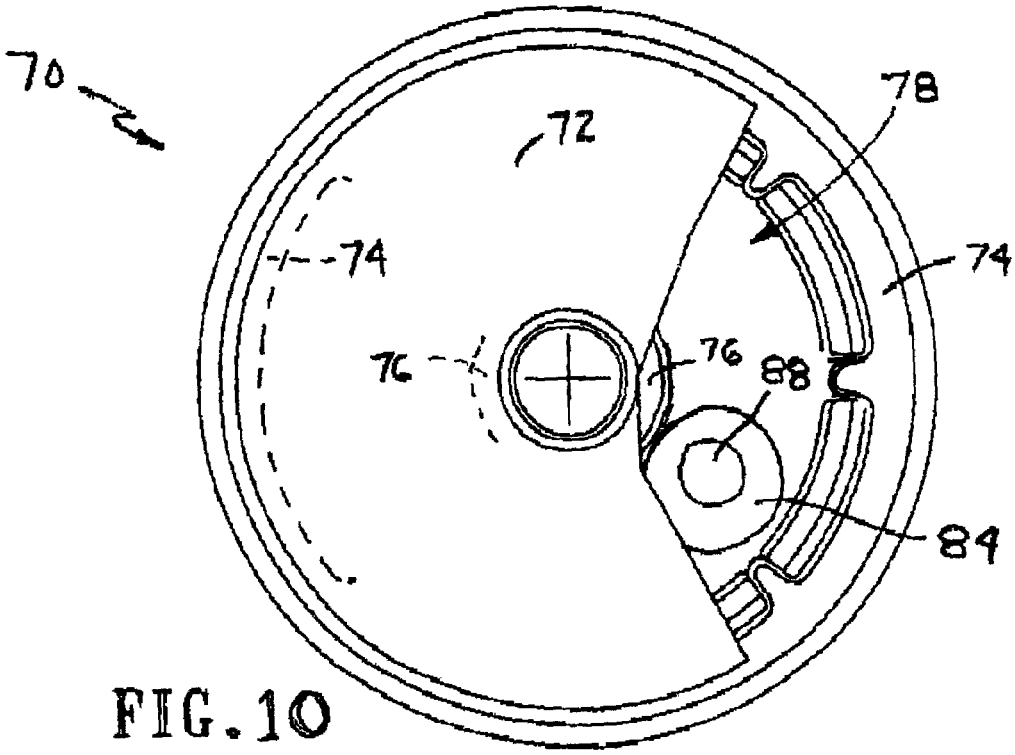
FIG. 10 is a bottom plan view of the dispensing lid of FIG. 9 with the sealing layer shown partly broken away.

While the arrangement of the described preferred embodiment provides for two separately sealed compartments containing the same or different fluent materials, it will be understood that the invention is not limited to a two compartment dispensing lid closure. For instance, the lid closure may have only one compartment as shown in FIGS. 9 and 10, in which case the diametrical recess 18 and all or portions of the radial sealing surfaces 52, 54 are eliminated, or it may have three or more compartments, in which case three or more recesses and radial sealing surfaces will be formed, e.g., angularly spaced 120° apart for three compartments, 90° apart for four compartments, etc.

The lid closure 10 is also provided with an X-shaped perforation or weakened region 56 in the center thereof through which a conventional drinking straw (not shown) may be inserted. A central hole in the lid closure of a size to accommodate the straw may also be used. The sealing layer 50 is provided with a central opening 51 (FIG. 3) for the straw although opening 51 may be eliminated and the straw may be used to puncture the sealing layer 50.

Figure 6:
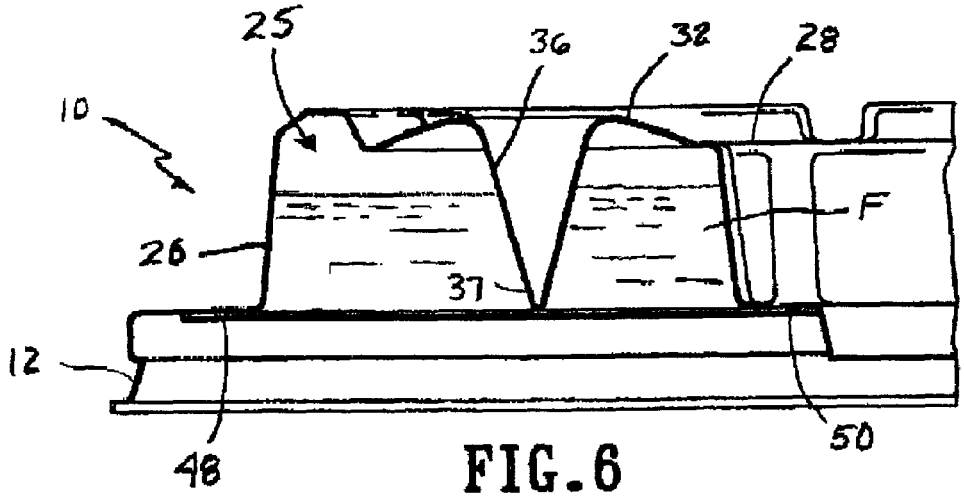
FIG. 6 is a fragmentary cross-sectional view of the dispensing lid of the invention, taken along line 6—6 of FIG. 2, showing the conical recess for puncturing the sealing layer.

In FIG. 6, the circular domed portion 32 and conical recess 36 are shown in enlarged cross-section in their manufactured or pre-use condition containing a fluent material F. As illustrated, the domed portion 32 and conical recess 36 are formed of substantially the same material thickness as the other portions of the lid closure. The apex or tip 37 of the conical recess 36 is formed at the same elevation as the coplanar sealing surfaces 48–54 so that it will be in contact with the sealing layer 50 when it is applied to the underside of the lid closure. However, the tip 37 may be formed at a higher elevation than the sealing surfaces 48–54 so that it will be spaced above the sealing layer 50. Generally, the higher the elevation of the tip 37, i.e., the greater the spacing of the tip from the sealing layer, the smaller the diameter of the hole that will be punctured in the sealing layer 50 by the conical recess 36.

Figure 7:
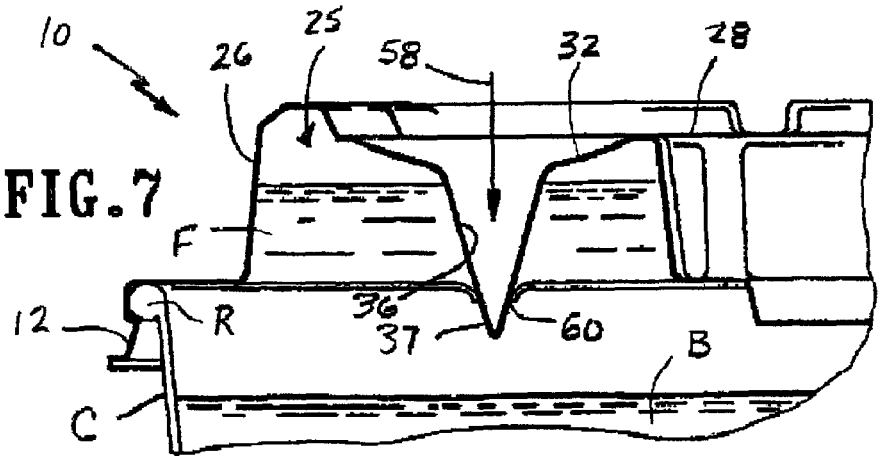
FIG. 7 is a fragmentary cross-sectional view of the dispensing lid of the invention showing the conical recess puncturing the sealing layer.
Figure 8:
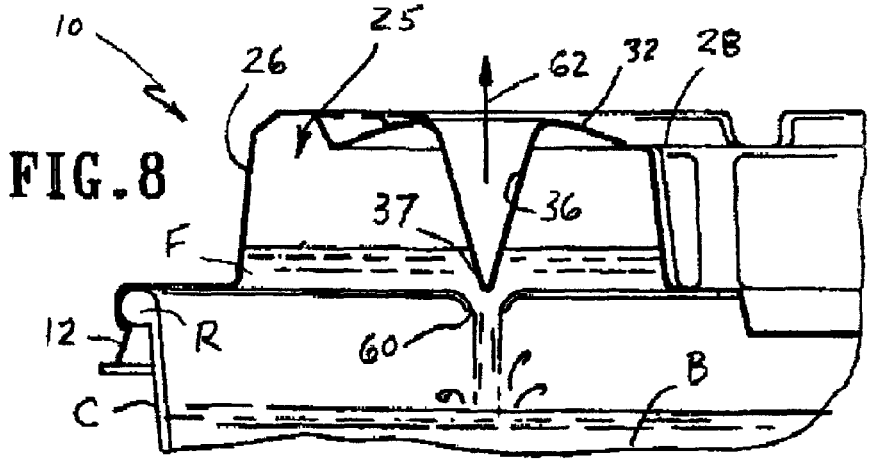
FIG. 8 is a fragmentary cross-sectional view of the dispensing lid of the invention showing the position of the conical recess after it has punctured the sealing layer.

The operation and use of the dispensing lid closure of the invention is illustrated in FIGS. 7 and 8. To use the lid closure 10, it is first attached to the rim R of a container, such as container C containing a beverage B by means of the annular skirt 12. To dispense fluent material F from the compartment 25, the convex domed portion 32 is pressed inwardly by the user/consumer in the direction as shown by the arrow 58 in FIG. 7 until the tip 37 of the conical recess 36 punctures a hole 60 or otherwise tears an opening in the sealing layer 50. The user-applied pressure inverts the convex domed portion 32 to an inwardly concave configuration as shown in FIG. 7. When the user/consumer releases the pressure from the domed portion 32, it returns or retracts, i.e., "oil cans," toward its original convex position as shown by the arrow 62 in FIG. 8, thereby releasing or dispensing the fluent material F from compartment 25 through the punctured hole 60 in the sealing layer 50 and into the beverage B in container C.

Although it is preferable that the domed portion 32 be designed to automatically retract or "oil can" to its original convex position when pressure is released from the domed portion, it is only necessary that the tip 37 of the conical recess retract from the punctured hole 60 or torn opening sufficiently to allow the fluent material F to flow freely out of the compartment to which it was charged. The size of the punctured hole 60 or torn opening in the sealing layer is preferably sufficiently large to allow entry of air into the compartment if the fluent material is a liquid so that a vacuum does not form in the compartment over the liquid that may inhibit outflow of the liquid. If necessary, a vent (not shown) with a weakened or frangible portion similar to the X-shaped perforation 56 may be provided in the top surface of each compartment to be broken by the user/consumer after the lid closure is attached to a beverage container.

After the fluent material F is dispensed into the container C, the user/consumer may insert a drinking straw into the container through the X-shaped perforation 56 and consume the beverage now containing the fluent material. Non-limiting examples of the applications for the dispensing lid closure of the invention include: adding a liquid or solid (granular or powdered) flavorant to a cold soft drink beverage; adding a flavorant and/or sweetener and cream to a hot beverage, such as tea or coffee; and adding a granular or powdered confection to a hot or cold beverage.

Referring to FIGS. 9 and 10, there is illustrated another embodiment of the lid closure of the invention with a single compartment for fluent material and two domed portions with conical recesses. In this embodiment, the lid closure 70 is formed in the same manner as lid closure 10 except that the diametrical recess 18, linear surfaces 44, 46 and sealing surfaces 52, 54 have been eliminated. Foil sealing layer 72 is adhesively or heat sealingly affixed to the two concentric annular sealing surfaces 74, 76 on the underside of the lid closure. The single compartment 78 is formed by a raised, washer-like section 80 having a flat top surface 82. A pair of domed portions 84, 86 with central conical recesses 88, 90 are formed in top surface 82, it being understood that only one such domed portion with central conical recess is necessary for puncturing the sealing layer 72 and dispensing the fluent material contained in the single compartment 78.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim is:

1. A lid closure adapted to dispense a fluent material into a container comprising a lid formed of a sheet material having a substantially uniform thickness, said lid having formed therein at least one compartment adapted to contain the fluent material for dispensing into the container, a convex domed portion formed in said lid and at least one conical recess formed in the domed portion, said conical recess having a tip extending into said compartment, a sealing layer affixed to said lid for sealing the fluent material in the compartment whereby pressure applied to said conical recess urges the domed portion and the tip of the conical recess toward the sealing layer to puncture the same and dispense the fluent material from the compartment and into the container.

2. The lid closure of claim 1, wherein the convex domed portion has an original formed position and automatically returns to its original formed position when the pressure applied to the conical recess is released.

3. The lid closure of claim 1, wherein said lid has a top and a bottom, the bottom of the lid having a sealing surface for sealingly affixing the sealing layer to the lid.

4. The lid closure of claim 3, wherein the sealing surface comprises two coplanar concentric annular surfaces.

5. The lid closure of claim 4, wherein the sealing surface further comprises at least one radial surface extending between and coplanar with said concentric annular surfaces.

6. The lid closure of claim 5, wherein the sealing surface further comprises a plurality of radial surface extending between and coplanar with said concentric annular surfaces.

7. The lid closure of claim 1, wherein the sealing layer is made of a sheet material from the group comprising a metal foil, a polymeric foil, and a metal/polymeric foil laminate.

8. The lid closure of claim 1, wherein the lid has means formed therein for receiving a drinking straw and an annular skirt for attachment to the container.

9. The lid closure of claim 1, wherein the lid is formed with at least one raised section forming said compartment, said raised section having a top surface, the convex domed portion and conical recess being formed in said top surface.

10. The lid closure of claim 1, wherein the lid is formed with a plurality of raised arcuate sections each forming a compartment, each arcuate section having a top surface and a convex domed portion and a conical recess being formed in each top surface.

11. The lid closure of claim 1, including indicia formed in the lid.

12. The lid closure of claim 1, wherein the container contains a soft drink beverage and the fluent material is a liquid, granular or powdered flavorant.

13. The lid closure of claim 1, wherein the sealing layer is affixed to the lid by heat sealing or adhesive.

14. The lid closure of claim 1, wherein the lid is vacuum-formed of a polystyrene sheet material.

15. The lid closure of claim 1, wherein the sealing layer has a central opening.

16. A lid closure adapted to dispense a fluent material into a container comprising a lid formed of a polymeric sheet material having a substantially uniform thickness, said lid having formed therein at least two raised arcuate portions each enclosing a compartment adapted to contain the fluent material for dispensing into the container, a convex domed portion having a conical recess formed in each raised arcuate portion, each recess having a tip extending into the compartment associated therewith, said lid having two coplanar concentric annular sealing surfaces and two radial sealing surfaces extending between and coplanar with said annular sealing surfaces, a sealing layer affixed to said sealing surfaces for sealing the fluent material in the compartments whereby pressure applied to one of said conical recesses urges the tip of the conical recess toward the sealing layer to puncture the same and dispense the fluent material from the associated compartment into the container.

17. A method of making a dispensing lid closure for dispensing a fluent material into a container, said closure comprising lid formed of a sheet material, said lid having formed therein a compartment adapted to contain the fluent material for dispensing into the container, comprising the steps of:

forming a dispensing lid closure with a raised section having a convex domed portion with a conical recess extending into said compartment;

orienting the dispensing lid closure with the compartment upwardly open and the apex of the conical recess oriented upwardly;

charging the upwardly open compartment with a quantity of the fluent material; adhesively affixing a sealing layer to the lid closure to seal the fluent material in the compartment.

18. A method of using a dispensing lid closure for dispensing a fluent material into a container, said closure comprising lid formed of a sheet material, said lid having formed therein a compartment adapted to contain the fluent material for dispensing into the container and a convex domed portion with a conical recess having a tip extending into said compartment, and a sealing layer affixed to said lid for sealing the fluent material in the compartment, comprising the steps of:

securing the dispensing lid closure to the container;

applying pressure to the convex domed portion with the conical recess inwardly toward the container;

puncturing a hole in the sealing layer with the tip of the conical recess;

releasing the pressure on the convex domed portion to automatically permit the tip of the conical recess to retract from the hole punctured in the sealing layer; and dispensing the fluent material into the container.

19. A lid closure adapted to dispense a fluent material into a container comprising:

a lid formed of a sheet material having a substantially uniform thickness, said lid comprising:

at least one compartment formed therein adapted to contain the fluent material for dispensing into the container;

a convex domed portion formed in said lid; and at least one tapered recess being formed in the domed portion having a tip extending into said compartment; and a sealing layer affixed to said lid for sealing the fluent material in the compartment, whereby pressure applied to said tapered recess urges the domed portion toward the sealing layer such that the tip punctures the same and dispenses the fluent material from the compartment and into the container.

20. A lid closure adapted to dispense a fluent material into a beverage container comprising a lid formed of a sheet material having a substantially uniform thickness, said lid having formed therein at least one compartment adapted to contain the fluent material for dispensing into the container, a convex domed portion formed in said lid and at least one tapered recess formed in the domed portion, said tapered recess terminating substantially in a tip extending into said compartment, a sealing layer affixed to said lid for sealing the fluent material in the compartment whereby pressure applied to said conical recess urges the domed portion and the tip of the tapered recess toward the sealing layer to puncture the same and dispense the fluent material from the compartment and into the container.

21. The lid closure of claim 20, wherein the convex domed portion has an original formed position and automatically returns to its original formed position when the pressure applied to the tapered recess is released.

22. The lid closure of claim 20, wherein the lid is formed with at least one raised section forming said compartment, said raised section having a top surface, the convex domed portion and tapered recess being formed in said top surface.

23. The lid closure of claim 20, wherein the lid is formed with a plurality of raised arcuate sections each forming a compartment, each arcuate section having a top surface and a convex domed portion and a tapered recess being formed in each top surface.

* * * * *